US005370022A

United States Patent [19]

Rodriguez et al.

[11] Patent Number: 5,370,022

[45] Date of Patent: Dec. 6, 1994

[54] FASTENER DRIVING LEVERAGE TOOL

[76] Inventors: Orelio O. Rodriguez, 4333 E. Dover Strav., Tucson, Ariz. 85706; Richard J. Durako, 13155 Camino La Cebadilla, Tucson, Ariz. 85749

[21] Appl. No.: 67,471

[22] Filed: May 25, 1993

[51] Int. Cl.[5] ..... B25B 23/00

[52] U.S. Cl. ..... 81/462; 81/436; 81/451; 81/DIG. 1

[58] Field of Search ..... 81/462, 180.1, DIG. 1, 81/487, 58.1, 436, 450, 451, 456

[56] References Cited

U.S. PATENT DOCUMENTS

| | | | |
|---|---|---|---|
| 2,632,486 | 3/1953 | Fetsko | 8/462 |
| 2,679,270 | 5/1954 | Krause | 81/462 |
| 2,745,448 | 5/1956 | Leake | 81/462 |
| 2,818,894 | 1/1958 | Miller | 81/462 |
| 3,424,212 | 1/1969 | Kemper . | |
| 3,561,510 | 2/1971 | Johnson . | |
| 3,656,523 | 4/1972 | McGee . | |
| 3,797,546 | 3/1974 | McGee . | |
| 4,000,767 | 1/1977 | Geng . | |
| 4,169,395 | 10/1979 | Hoskinson . | |
| 4,233,727 | 11/1980 | Kautetzky et al. . | |
| 4,375,772 | 3/1983 | Brackett et al. | 81/462 |

*Primary Examiner*—D. S. Meislin

[57] ABSTRACT

A fastener driving tool which uses the mechanical advantage of a lever to aid in the loosening and tightening of screws, bolts, nuts, and the like. The tool amplifies the force of a user that is exerted on a fastener bit (e.g. screwdriver blade) and a fastener head (e.g. screw head) thereby reducing the chance of the fastener bit slipping off the fastener head. A lever arm has a first end which attaches to an adjacent nearby screw or bolt. The fastener bit is attached to the lever arm and engages the targeted fastener head. The fastener bit functions as the fulcrum (i.e. the support about which the lever turns) of the lever arm. The user exerts downward force on the second end of the lever arm while using a conventional torquing tool (e.g. screwdriver, wrench, etc.) to loosen or tighten the hard to turn fastener. The force amplifying principle of the lever amplifies the downward force of the user many times over so that much more force is exerted on the fastener head than can be applied with a conventional tool. The tool is particularly useful in loosening corroded or stuck fasteners which are difficult or impossible to remove with conventional tools. It is highly adjustable for use in a variety of situations.

18 Claims, 4 Drawing Sheets

| FORCE APPLIED ON HANDLE (LBS.) | 1 | 2 | 3 | 4 | 5 | 6 |
|---|---|---|---|---|---|---|
| 160 | 2080 | 1040 | 693 | 520 | 416 | 347 |
| 140 | 1820 | 910 | 607 | 455 | 364 | 303 |
| 120 | 1560 | 780 | 520 | 390 | 312 | 260 |
| 100 | 1300 | 650 | 433 | 325 | 260 | 217 |
| 80 | 1040 | 520 | 347 | 260 | 208 | 173 |
| 60 | 780 | 390 | 260 | 195 | 156 | 130 |
| 40 | 520 | 260 | 173 | 130 | 104 | 87 |
| 20 | 260 | 130 | 87 | 65 | 52 | 43 |

DISTANCE BETWEEN ANCHOR AND CHUCK (INCHES)

FIG. 6

FASTENER DRIVING LEVERAGE TOOL

BACKGROUND OF INVENTION

This invention relates generally to hand tools and more specifically to hand tools for torquing hard to turn screws, fasteners, and the like.

A wide variety of fasteners are known in the art. Of particular interest to this invention are fasteners which are secured or removed using a torquing or twisting action. These include, but are not limited to, wood screws, metal screws, various bolts, nuts, and the like.

A corresponding wide variety of fastener tools are also known in the art. These include flat head screwdrivers, phillips head screwdrivers, allen head wrenches, star head drives, socket drives, and others. Each of these tools are used to apply torque to a fastener.

Although these tools function well in many situations, there are many situations in which they function poorly or do not function at all. One area in which the known tools function poorly is in loosening and tightening very hard to turn screws and the like.

Everyone has experienced the frustration of attempting to either loosen a frozen screw or tighten a hard to turn screw. All too often the screwdriver blade will repeatedly slip off the head of the screw. Worse, when the screwdriver blade slips off the screw head, the screw head is often damaged making further attempts even more difficult.

To prevent the screwdriver blade from slipping, the user must exert inordinate amounts of force to hold the screwdriver blade firmly against the screw head. This is a strenuous, and often unsuccessful, solution to the dilemma.

Prior attempts to solve this problem generally involved modifications to a conventional screwdriver handle to allow a user to exert increased pressure and/or torque on the screwdriver blade and screw head. These tools, although improvements, do not amplify the force of the user to achieve significant improvements in effectiveness. Because of this, these tools have achieved only moderate success.

There continues to be a need for a device which is simple and which overcomes the problem of loosening and tightening very hard to turn fasteners such as screws, bolts, nuts, and the like.

Clearly, there exists a need for a new fastener driving tool which is simple, easily manufactured, adjustable, and amplifies a user's strength for loosening or tightening hard to turn fasteners.

SUMMARY OF THE INVENTION

The invention creates a fastener driving tool which uses the mechanical advantage of a lever to aid in the loosening and tightening of screws, bolts, nuts, and the like. The tool amplifies the force of a user that is exerted on a fastener bit (e.g. screwdriver blade) and a fastener head (e.g. screw head) thereby reducing the chance of the fastener bit slipping off the fastener head.

A lever arm has a first end which attaches to an adjacent screw or bolt. The fastener bit is attached to the lever arm and engages the targeted fastener head. The fastener bit functions as the fulcrum (i.e. the support about which the lever turns) of the lever arm.

The user exerts downward force on the second end of the lever arm while using a conventional torquing tool screwdriver, wrench, etc.) to loosen or tighten the hard to turn fastener. The force amplifying principle of the lever amplifies the downward force of the user many times over so that much more force is exerted on the fastener head than can be applied with a conventional tool.

The tool is particularly useful in loosening corroded or stuck fasteners which are difficult or impossible to remove with conventional tools. It is highly adjustable for use in a variety of situations.

The amplifying principle of levers has been know for thousands of years, however, the invention's novel adaptation of the lever has not been previously used. The invention applies the mechanical advantage gained by levers to the problem of torquing fasteners.

The advantage gained is demonstrated by an example. Using the invention, twenty pounds of force applied by a user is amplified into 260 lbs. of force on the fastener head. The user's force is amplified by a factor of 13. The amplified force greatly reduces the chance of slippage between the fastener bit and the fastener head.

The invention is comprised of four major parts: an anchor, a lever arm, a chuck, and a handle.

The anchor secures one end of the lever arm to a fixed object. In the preferred embodiment, the anchor is adapted to attach to an adjacent loosened screw or bolt. The anchor fits under and around the head of the loosened screw or bolt, thereby securing one end of the lever arm.

In alternate configurations, the anchor attaches to the middle portion of the lever arm while securing the lever arm to a loosened screw or bolt. In this configuration the anchor serves as the fulcrum for the lever arm.

Other features of the anchor will be described below.

The lever arm operates as a lever and creates the mechanical advantage. The lever arm is rotatably attached to the anchor to permit the lever arm to rotate as needed. The lever arm holds the chuck and fastener bit assembly which functions as a fulcrum for the lever arm. Force exerted by a user on the lever arm is amplified and transferred to the fastener bit and fastener head.

The chuck holds the fastener bit and engages the torque applying tool permitting the torque applying tool to turn the fastener bit. The chuck is slidable mounted on the lever arm so that it is infinitely adjustable to a particular use.

The chuck and fastener bit form the fulcrum for the lever arm. Amplified force is transferred from the lever arm, to the chuck, to the fastener bit, and finally to the fastener head.

Almost any conventional torque applying tool is used to transmit torque to the chuck and fastener bit. These include, but are not limited to, various types of screwdrivers, wrenches, socket wrenches, allen wrenches, air powered tools, and the like.

The lever arm forms the main body of the tool and connects all the major components. In the preferred embodiment, the lever arm is comprised of two parallel rails to which are attached to the anchor at one end, the handle at the other end, and on which the chuck is slidable mounted.

The lever arm is made to any convenient length. The longer the lever arm, the greater the mechanical advantage. It is envisioned that the lever arm's length is adjustable so that mechanical advantage is increased as needed.

An embodiment of the invention having a short thirteen inch lever arm provides a thirteen fold increase in force over the user's exerted force.

The handle attaches to one end of the lever arm. A user exerts force on the handle. The handle also effectively extends the overall length of the lever arm and thus increases the mechanical advantage of the invention. In the preferred embodiment, the handle is foldable.

The significant features of the invention are illustrated in the figures and described more fully below.

BRIEF DESCRIPTION THE DRAWINGS

FIG. 5*a*–5*d* show the preferred embodiment of the anchor.

FIG. 6 is a chart showing the mechanical advantage gained by the invention.

DETAILED DESCRIPTION OF THE DRAWINGS

Figure 1:
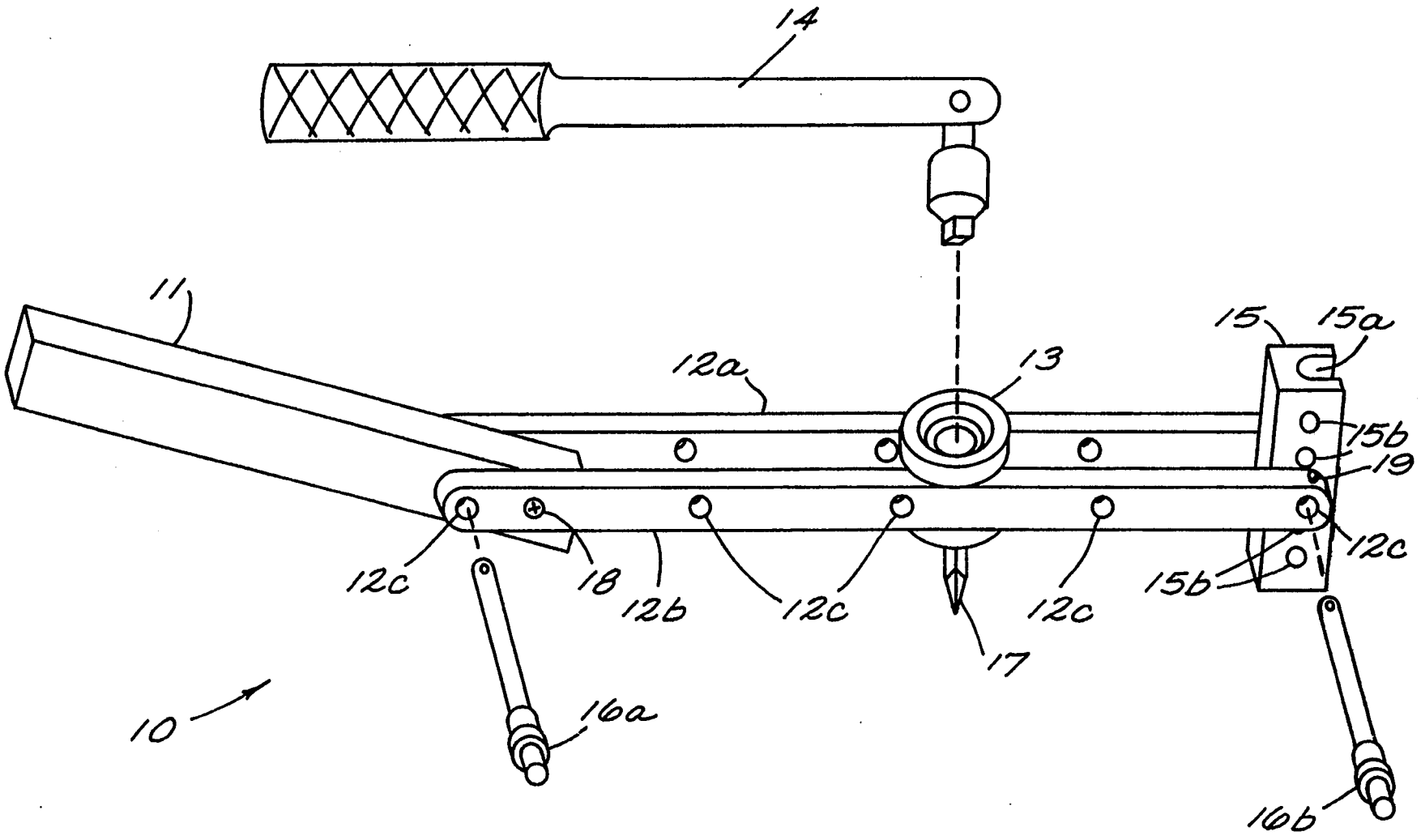
FIG. 1 is a perspective view of the preferred embodiment of the invention.

FIG. 1 is a perspective view of the preferred embodiment of the invention.

Leverage tool 10 is comprised of handle 11, lever arms 12*a* and 12*b*, chuck 13, torquing tool 14, and anchor 15. Spring loaded pins 16*a* and 16*b* permit tool 10 to be easily reconfigured and adjusted. Fastener bit 17 is held in chuck 13.

Handle 11 is rotatably attached to lever arms 12*a* and 12*b* with screw 18. Handle 11 is secured in place by pin 16*a* which slides through holds in levers arms 12*a* and 12*b* and a hole in handle 11. The folding feature permits handle 11 to be folded for storage or unfolded to extend the effective length of lever arms 12*a* and 12*b*.

Anchor 15 is designed to secure tool 10 to a loosened screw, bolt, or the like. Aperture 15*a* is formed in anchor 15 for fitting around the head of a screw, bolt, nut, or the like. A second aperture (not shown) is formed in the opposite end of anchor 15. The second aperture is preferably of a different size or configuration to permit anchor 15 to attach to different size or types of fasteners.

Anchor 15 is rotatably attached to lever arms 12*a* and 12*b* by pin 16*b*. Pin 16b slides through holes 12*c* in lever arms 12*a* and 12*b* and slides through one of the holes 15*b* in anchor 15. Anchor 15 has several holes 15*b* which permit anchor 15 to be adjusted relative to lever arms 12*a* and 12*b*.

Anchor 15 is adjustable to any of several positions along lever arms 12*a* and 12*b* where holes 12*c* are provided. Adjusting anchor 15 makes tool 10 very versatile.

Chuck 13 is slidable mounted between lever arms 12*a* and 12*b*. Chuck 13 also rotates freely while supported by lever arms 12*a* and 12*b*. Chuck 13 holds fastener bit 17 and engages torquing tool 14. Torque is transferred from torquing tool 14, to chuck 13, and finally to fastener bit 17.

In the preferred embodiment, fastener bit 17 is removable and any conventional bit is usable in chuck 13. Many bit holding designs are envisioned and are commonly known in the art, including, but not limited to, snap types, magnetic types, and others.

Those of ordinarily skill in the art readily see many alternate embodiments of chuck 13 which perform substantially the same function or work, in substantially the same way, to obtain substantially the same overall result.

Torquing tool 14 is shown as a conventional socket wrench, however, it is envisioned that any conventional torquing tool is usable. Torquing tool 14 engages chuck 13. Torque from torquing tool 14 is transferred through chuck 13 to fastener bit 17.

Stop pins 19 extend from the ends of lever arms 12*a* and 12*b*. Stop pins 19 prevent chuck 13 from sliding off lever arms 12*a* and 12*b* when anchor 15 is not in place.

Pins 16*a* and 16*b* are any pins suitable for holding handle 11 and anchor 15 in place. The preferred embodiment uses spring loaded locking pins which remain securely in place until released by the user.

FIG. 2*a* shows a side view of the invention when used to torque a fastener.

Anchor 15 attaches to loosened screw 20 securing anchor 15. Fastener bit 17 engages target screw 21. The user applies force on handle 11 as shown by arrow 23. The mechanical advantage gained by handle 11 and lever arm 12 amplify the force exerted on handle 11. While exerting force on handle 11, the user operates torquing tool 14 which transfers torque through chuck 13, bit 17, and to target screw 21.

Using a short thirteen inch tool, the user's force on handle 11 is capable of being amplified thirteen fold and exerted on target screw 21.

Figure 3:
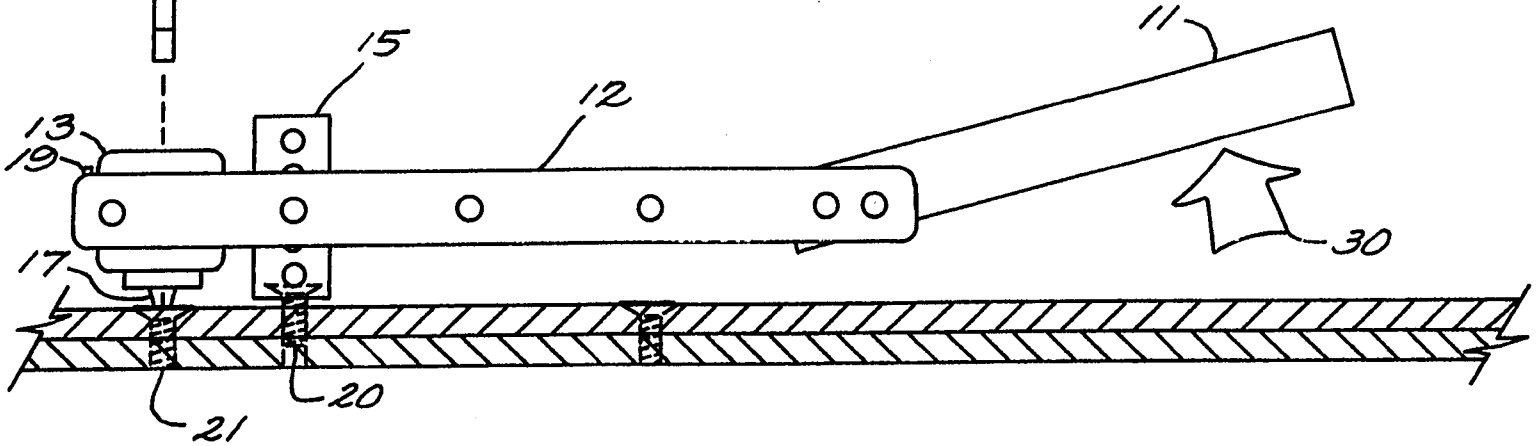
FIG. 3 shows a side view of the invention in an alternate configuration.

FIG. 3 shows a side view of the invention in a different configuration.

Figure 2:
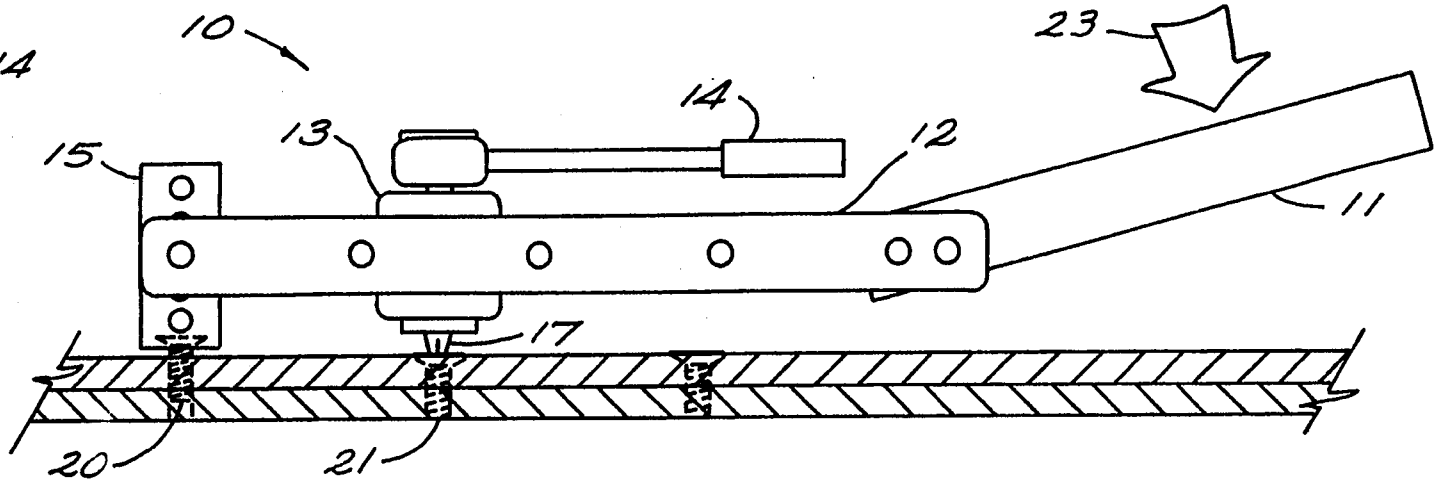
FIG. 2 shows a side view of the invention when used to remove a faster.

Tool 10 operates similar to the configuration in FIG. 2, but with some minor modifications. Upward force is exerted on handle 11 as shown by arrow 30 and anchor 15 and chuck 13 are moved to different positions. Anchor 15 is moved to a position along lever arm 12 and chuck 13 is positioned near the end of lever arm 12. Anchor 15 attaches to loosened screw 20.

Upward force exerted on handle 11 is amplified and converted into downward force on target screw 21. The mechanical advantage of lever arm 12 and handle 11 amplify the force of the user many times over.

Torquing tool 14, shown as a screwdriver type tool, engages chuck 13 which transfers torque to bit 17 and target screw 21.

Although screws are shown in the figures, those of ordinary skill in the art readily recognize that the invention is equally useful on other fasteners including, but not limited to, bolts, nuts, and the like.

Figure 4:
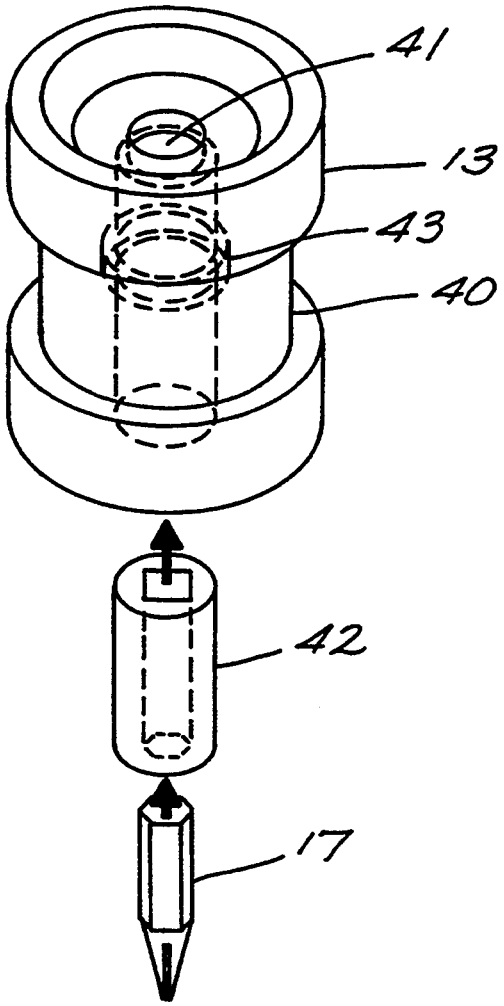
FIG. 4 shows the preferred embodiment of the chuck.

FIG. 4 shows the preferred embodiment of the chuck.

Chuck 13 is basically cylindrical in shape with a notch 40 cut out around the center. Lever arms (not shown) fit into notch 40 and support chuck 13. A cylindrical hole 41 passes through the axial center of chuck 13 receiving a bit 17 and a torquing tool (not shown). Hole 41 is smaller diameter near the top of chuck 13 to prevent bit 17 passing through hole 41.

In the preferred embodiment, an inner chuck 42 is used. Inner chuck 42 is cylindrical and rotates freely inside chuck 13. Inner chuck 42 holds bit 17 and engages torquing tool (not shown). Also in the preferred embodiment, groove 43 is machined into the wall of cylindrical hole 41. Groove 43 holds a rubber retainer ring (not shown) which holds inner chuck 42 in place.

It should be apparent that the invention is easily adapted for use with most torquing tools including, but not limited to, flathead screwdrivers, phillips head screwdrivers, and screwdrivers and wrenches having $\frac{1}{4}''$ and $\frac{3}{8}''$ drives and the like.

FIGS. 5*a* thru 5*d* show the preferred embodiment of the anchor means.

Figure 5A:
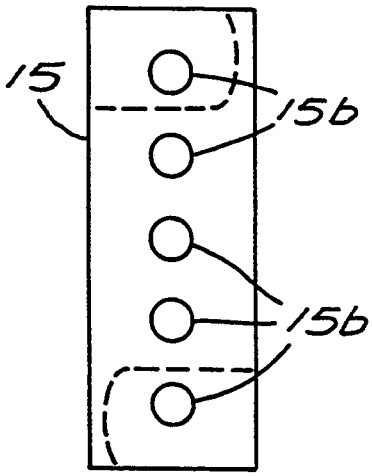

FIG. 5*a* is a side view of anchor 15. Adjustment holes 15*b* permit anchor 15 to be adjusted relative to lever arms (not shown).

Figure 5B:
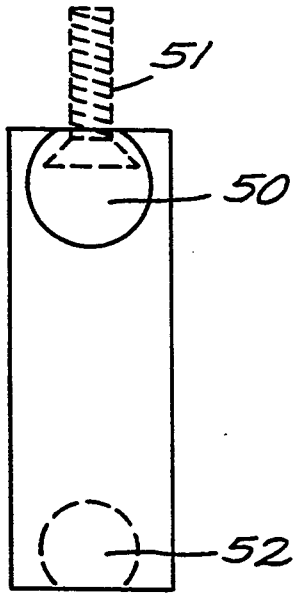

FIG. 5*b* is a front view of anchor 15. Aperture 50 enables anchor 13 to attach to a loosened screw, bolt, nut, or the like 51. A different size aperture is formed in the bottom rear of anchor 15 and is depicted by broken lines 52.

Figure 5C:
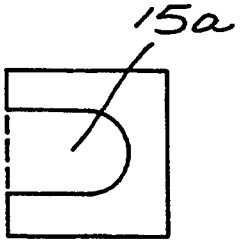

FIG. 5*c* is a top view of anchor 15 showing an aperture 15*a*.

Figure 5D:
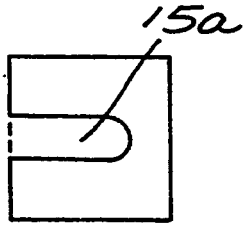

FIG. 5*d* is a bottom view of anchor 15 showing an aperture 15*a*. Note that apertures 15*a* on the top and bottom of anchor 15 are of different sizes to permit anchor 15 to attach to different size screws and bolts.

FIG. 6 is a chart showing the mechanical advantage obtained using the invention. The vertical axis is the force, in lbs., exerted by a user on the handle. The horizontal axis is the distance from the center of the chuck to the center of the anchor when the anchor is positioned at the end of the lever arm.

The chart shows the resulting force, in lbs., exerted on the fastener head when using a thirteen inch tool.

The chart shows that 20 lbs. of force by a user, with the chuck one inch from the anchor, causes 260 lbs. of force on the head of the fastener. It is apparent that as the distance between the anchor and the chuck increases, the mechanical advantage is reduced. Thus, when the chuck is 6 inches from the anchor, 20 lbs. of force only causes 43 lbs. of force on the head of the fastener.

Those of ordinary skill in the art readily see many alternate embodiments of the disclosed invention which perform substantially the same function or work, in substantially the same way, to obtain substantially the same overall result and would therefore infringe on the disclosed invention. It is clear from the foregoing that the present invention represents a new and useful tool for torquing hard to turn fasteners such as screws, bolts, nuts, an the like.

What is claimed is:

1. A screw driving tool comprising:

a) an anchor means for attaching to the head of a loosened screw;

b) a chuck means for holding a screw bit and engaging a torque applying tool;

c) a lever arm means for supporting said anchor means and said chuck means and for transferring operator applied pressure to said chuck means, said lever arm means having a body portion having at least two attachment points for selective attachment of said anchor means along said body portion, said body portion supporting said chuck means; and, d) a handle attached to a first end of said lever arm means.

2. The screw driving tool according to claim 1 wherein said chuck means is slideably adjustable to different positions along said lever arm means.

3. The screw driving tool according to claim 2 wherein said anchor means is attachable to a position on said body portion between said chuck means and said handle such that operator supplied upward force on said handle forces said chuck means downward.

4. The screw driving tool according to claim 3 further including a torque applying tool, said torque applying tool engaging said chuck means.

5. The screw removing tool according to claim 4 wherein said torque applying tool is a screw driver.

6. The screw removing tool according to claim 4 wherein said torque applying tool is a wrench.

7. The screw removing tool according to claim 6 further including spring loaded removable locking pin means for rotatably connecting said anchor means to said lever arm means.

8. A fastener driving tool comprising:

a) an anchor means for attaching to a fastener;

b) a chuck means for holding a fastener bit and engaging a torque applying tool such that torque from said torque applying tool is transferred to said fastener bit; and, c) a lever arm means for supporting said chuck means and for transferring operator applied force to said chuck means, said lever arm means attachable to said anchor means, said lever arm means having a body portion for supporting said chuck means, said body portion having:

1) at least two attachment mechanisms for selectively attaching said anchor means along said body portion, 2) a first end, and, 3) a second end.

9. The fastener driving tool according to claim 8 wherein said chuck means is movable to different positions along said body portion.

10. The fastener driving tool according to claim 9 wherein said anchor means is attachable to said body portion between said chuck means and said second end.

11. The fastener driving tool according to claim 10 further including a torque applying means for supplying torque to said chuck means.

12. The fastener driving tool according to claim 11 wherein said torque applying means is a wrench.

13. The fastener driving tool according to claim 12 further comprising a handle means attached to said second end of said lever arm means.

14. The fastener driving tool according to claim 13 further including spring loaded removable locking pin means for rotatably connecting said anchor means to said lever arm means.

15. The fastener driving tool according to claim 13 wherein said lever arm means is foldable.

16. A fastener driving device comprising:

a) an anchor means for attaching to a fastener;

b) a torque applying means for providing torque;

c) at least one fastener bit;

d) a chuck means for holding said at least one fastener bit and engaging said torque applying means such that torque from said torque applying means is transferred to said fastener bit;

e) a lever arm means for supporting said chuck means and for transferring operator applied force to said chuck means, said lever arm means having a first end and a second end and 1) a body portion, said body portion supporting said chuck means and having at least two attachment means for selective operator attachment of said anchor means along said body portion and such that at least one of said attachment means is between said chuck means and said second end of said lever arm; and, f) handle means attached to said second end of said of said lever arm means.

17. The fastener driving device according to claim 16 wherein said torque applying means is a screwdriver.

18. The fastener driving device according to claim 17 wherein said torque applying means is a wrench.

* * * * *